US008953966B2

(12) United States Patent
Hase et al.

(10) Patent No.: US 8,953,966 B2
(45) Date of Patent: Feb. 10, 2015

(54) FIXING DEVICE AND IMAGE FORMING APPARATUS

(71) Applicants: Takamasa Hase, Shizuoka (JP); Tadashi Ogawa, Tokyo (JP); Takeshi Uchitani, Kanagawa (JP); Teppei Kawata, Kanagawa (JP); Shuutaroh Yuasa, Kanagawa (JP); Kensuke Yamaji, Kanagawa (JP)

(72) Inventors: Takamasa Hase, Shizuoka (JP); Tadashi Ogawa, Tokyo (JP); Takeshi Uchitani, Kanagawa (JP); Teppei Kawata, Kanagawa (JP); Shuutaroh Yuasa, Kanagawa (JP); Kensuke Yamaji, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 60 days.

(21) Appl. No.: 13/728,163

(22) Filed: Dec. 27, 2012

(65) Prior Publication Data

US 2013/0188977 A1 Jul. 25, 2013

(30) Foreign Application Priority Data

Jan. 19, 2012 (JP) ..... 2012-009210

(51) Int. Cl.
*G03G 15/20* (2006.01)

(52) U.S. Cl.
CPC ..... *G03G 15/2046* (2013.01); *G03G 15/205* (2013.01); *G03G 15/2042* (2013.01); *G03G 2215/2035* (2013.01)
USPC ..... 399/69; 399/334

(58) Field of Classification Search
CPC ..... G03G 15/2003; G03G 15/2078; G03G 15/2082
USPC ..... 399/69, 70, 334
See application file for complete search history.

(56) References Cited

U.S. PATENT DOCUMENTS

| | | | | |
|---|---|---|---|---|
| 2006/0051120 | A1* | 3/2006 | Kishi et al. | 399/69 |
| 2006/0177232 | A1 | 8/2006 | Ehara et al. | |
| 2007/0059011 | A1 | 3/2007 | Seo et al. | |

(Continued)

FOREIGN PATENT DOCUMENTS

| | | |
|---|---|---|
| JP | 8-220932 | 8/1996 |
| JP | 2007-079040 | 3/2007 |

(Continued)

OTHER PUBLICATIONS

U.S. Appl. No. 13/557,841, filed Jul. 25, 2012, Toshihiko Shimokawa, et al.

(Continued)

*Primary Examiner* — Hoang Ngo
(74) *Attorney, Agent, or Firm* — Harness, Dickey and Pierce P.L.C.

(57) ABSTRACT

A fixing device includes a fixing member including a heating unit, and a pressure member, the heating unit includes a sub-heater having a heat generating portion in a region smaller than a minimum paper width, a main heater having a heat generating portion at outside of the sub-heater, a first temperature detector to detect a temperature of the fixing member at the heat generating portion of the main heater, and a second temperature detector to detect the temperature at the heat generating portion of the sub-heater. The main heater and the sub-heater can be switched selectively, and the initial duty ratio at the start of PID temperature control by the sub-heater is determined in accordance with a difference between temperatures detected by the respective temperature detectors at the start of PID temperature control and a target temperature so that the temperature is not overshooting and dropped.

20 Claims, 7 Drawing Sheets

(56) References Cited

U.S. PATENT DOCUMENTS

| | | | | |
|---|---|---|---|---|
| 2007/0212089 | A1 | 9/2007 | Seo et al. | |
| 2007/0280754 | A1 | 12/2007 | Ogawa et al. | |
| 2008/0044196 | A1 | 2/2008 | Seo et al. | |
| 2009/0285592 | A1* | 11/2009 | Nakatani et al. | 399/70 |
| 2010/0061754 | A1 | 3/2010 | Ishigaya et al. | |
| 2011/0026988 | A1 | 2/2011 | Yoshikawa et al. | |
| 2011/0044734 | A1 | 2/2011 | Shimokawa et al. | |
| 2011/0052237 | A1 | 3/2011 | Yoshikawa et al. | |
| 2011/0058862 | A1 | 3/2011 | Yamaguchi et al. | |
| 2011/0058863 | A1 | 3/2011 | Shinshi et al. | |
| 2011/0064443 | A1 | 3/2011 | Iwaya et al. | |
| 2011/0064450 | A1 | 3/2011 | Ishii et al. | |
| 2011/0064490 | A1 | 3/2011 | Imada et al. | |
| 2011/0064502 | A1 | 3/2011 | Hase et al. | |
| 2011/0085832 | A1 | 4/2011 | Hasegawa et al. | |
| 2011/0091253 | A1 | 4/2011 | Seo et al. | |
| 2011/0116848 | A1 | 5/2011 | Yamaguchi et al. | |
| 2011/0129268 | A1 | 6/2011 | Ishii et al. | |
| 2011/0150518 | A1 | 6/2011 | Hase et al. | |
| 2011/0176821 | A1 | 7/2011 | Hase | |
| 2011/0182638 | A1 | 7/2011 | Ishii et al. | |
| 2011/0194869 | A1 | 8/2011 | Yoshinaga et al. | |
| 2011/0194870 | A1 | 8/2011 | Hase et al. | |
| 2011/0200368 | A1 | 8/2011 | Yamaguchi et al. | |
| 2011/0200370 | A1 | 8/2011 | Ikebuchi et al. | |
| 2011/0206427 | A1 | 8/2011 | Iwaya et al. | |
| 2011/0217056 | A1 | 9/2011 | Yoshinaga et al. | |
| 2011/0217093 | A1 | 9/2011 | Tokuda et al. | |
| 2011/0217095 | A1 | 9/2011 | Ishii et al. | |
| 2011/0222875 | A1 | 9/2011 | Imada et al. | |
| 2011/0222876 | A1 | 9/2011 | Yuasa et al. | |
| 2011/0222888 | A1 | 9/2011 | Ikebuchi et al. | |
| 2011/0222926 | A1 | 9/2011 | Ueno et al. | |
| 2011/0222929 | A1 | 9/2011 | Fujimoto et al. | |
| 2011/0222930 | A1 | 9/2011 | Fujimoto et al. | |
| 2011/0222931 | A1 | 9/2011 | Shinshi et al. | |
| 2011/0229161 | A1 | 9/2011 | Ueno et al. | |
| 2011/0229162 | A1 | 9/2011 | Ogawa et al. | |
| 2011/0229178 | A1 | 9/2011 | Ogawa et al. | |
| 2011/0229181 | A1 | 9/2011 | Iwaya et al. | |
| 2011/0229225 | A1 | 9/2011 | Ishii et al. | |
| 2011/0229226 | A1 | 9/2011 | Tokuda et al. | |
| 2011/0229227 | A1 | 9/2011 | Yoshikawa et al. | |
| 2011/0229228 | A1 | 9/2011 | Yoshikawa et al. | |
| 2011/0229236 | A1 | 9/2011 | Ehara et al. | |
| 2011/0274453 | A1 | 11/2011 | Shimokawa et al. | |
| 2011/0293309 | A1 | 12/2011 | Hase | |
| 2011/0311284 | A1 | 12/2011 | Seo et al. | |
| 2012/0045226 | A1 | 2/2012 | Hase et al. | |
| 2012/0051766 | A1 | 3/2012 | Ueno et al. | |
| 2012/0051774 | A1 | 3/2012 | Ikebuchi et al. | |
| 2012/0093531 | A1 | 4/2012 | Yuasa et al. | |
| 2012/0093551 | A1 | 4/2012 | Ogawa et al. | |
| 2012/0107005 | A1 | 5/2012 | Hase et al. | |
| 2012/0114354 | A1 | 5/2012 | Saito et al. | |
| 2012/0177388 | A1 | 7/2012 | Imada et al. | |
| 2012/0177424 | A1 | 7/2012 | Saito et al. | |
| 2012/0207523 | A1 | 8/2012 | Ueno et al. | |
| 2012/0219312 | A1 | 8/2012 | Yuasa et al. | |

FOREIGN PATENT DOCUMENTS

| | | |
|---|---|---|
| JP | 2008-185652 | 8/2008 |
| JP | 2008-275873 | 11/2008 |
| JP | 2010-066376 | 3/2010 |

OTHER PUBLICATIONS

U.S. Appl. No. 13/608,128, filed Sep. 10, 2012, Shuutaroh Yuasa, et al.

* cited by examiner

FIXING DEVICE AND IMAGE FORMING APPARATUS

CROSS-REFERENCE TO RELATED APPLICATION

This patent application is based on and claims priority pursuant to 35 U.S.C. §119 to Japanese Patent Application No. 2012-009210, filed on Jan. 19, 2012, in the Japanese Patent Office, the entire disclosure of which is hereby incorporated by reference herein.

BACKGROUND OF THE INVENTION

1. Field of the Invention

This invention relates to image forming apparatuses such as copiers, printers, facsimiles, multifunction apparatuses that print, fax, copy, and so on, and more specifically, to a fixing device which fixes an image formed on a recording medium.

2. Description of the Related Art

Conventionally, as image forming apparatuses such as copiers, printers, facsimiles, multifunction apparatuses that print, fax, copy, and so on, a device which employs a fixing belt being extended and wound around a plurality of rollers as a fixing member is known. Such a fixing device includes a fixing belt formed of an endless belt, a plurality of roller members around which the fixing belt wound for rotatable support, a heater disposed in one of the roller members, and a pressure roller that is a pressure member to contact the fixing belt. The heater heats the fixing belt via the roller member. A toner image formed on a recording medium is conveyed to a nip formed between the fixing belt and the pressure roller, and is fixed onto the recording medium by heat and pressure at the nip.

As an example of the fixing device, an on-demand fixing device which achieves a short warm-up time is disclosed in Japanese Patent Application Publication No. 2007-079040 (JP-2007-079040-A). The on-demand fixing device includes a fixing film (endless film) as a fixing member, a pressure roller as a pressure member, and a heater such as a ceramic heater. The heater is provided inside the fixing film to form a nip by contacting the pressure roller via the fixing film and heat the fixing film. A toner image formed on a recording medium is conveyed to the nip, and is fixed onto the recording medium by heat and pressure at the nip. In this configuration, even when papers of small size are fed continuously and the temperature of a region where the papers are not passing is increased, it is possible to perform paper feed operation continuously without lowering productivity by cooling the region where the papers are not passing using a cooling fan.

Further, Japanese Patent Application Publication No. 2010-066376 (JP-2010-66376-A) discloses a device which includes a first heater which heats a center portion of the recording medium and a second heater which heats end portions of the recording medium. The two heaters are operated independently. When papers of small size are fed continuously, only the first heater is used, and when the papers of large size are fed, the first and the second heaters are used. Thus, it is possible to prevent the temperature of the portion where the papers are not passing from being increased, thereby saving energy.

However, in the fixing device disclosed in JP-2007-79040-A, there is a problem that the device configuration becomes complex and the size of the device increases, and a temperature deviation in the axial direction is likely to occur due to an air flow. In the fixing device disclosed in JP-2010-66376-A, productivity may be lowered when papers of small size such as postcards and envelopes which are smaller than the first heater provided at the center portion, are fed continuously.

SUMMARY OF THE INVENTION

The present invention provides a fixing device that includes a fixing member including a heating unit, and a pressure member. The heating unit includes a sub-heater having a heating portion in a region smaller than a minimum paper width, a main heater having a heating portion in at least a region outside of the sub-heater, a first temperature detector to detect the temperature of the fixing member at the heat generating portion of the main heater, and a second temperature detector to detect the temperature of the fixing member at the heat generating portion of the sub-heater.

The main heater and the sub-heater can be switched selectively, such as at the start of warm-up or when the paper width of the received print job exceeds a predetermined value, the main heater is turned on, and when the paper width of the received print job is less than the predetermined value, the main heater is turned off, and PID temperature control by the sub-heater is started, and the initial duty ratio at the start of PID temperature control by the sub-heater is determined in accordance with a difference between temperatures detected by the respective temperature detectors at the start of PID temperature control by the sub-heater and a target temperature for the paper feed of the print job with either a temperature drop or overshoot.

BRIEF DESCRIPTION OF THE SEVERAL VIEWS OF THE DRAWINGS

A more complete appreciation of the invention and many of the advantages thereof may be obtained as the same become better understood by reference to the following detailed description when considered in connection with the accompanying drawings, wherein.

DETAILED DESCRIPTION OF THE INVENTION

Figure 1:
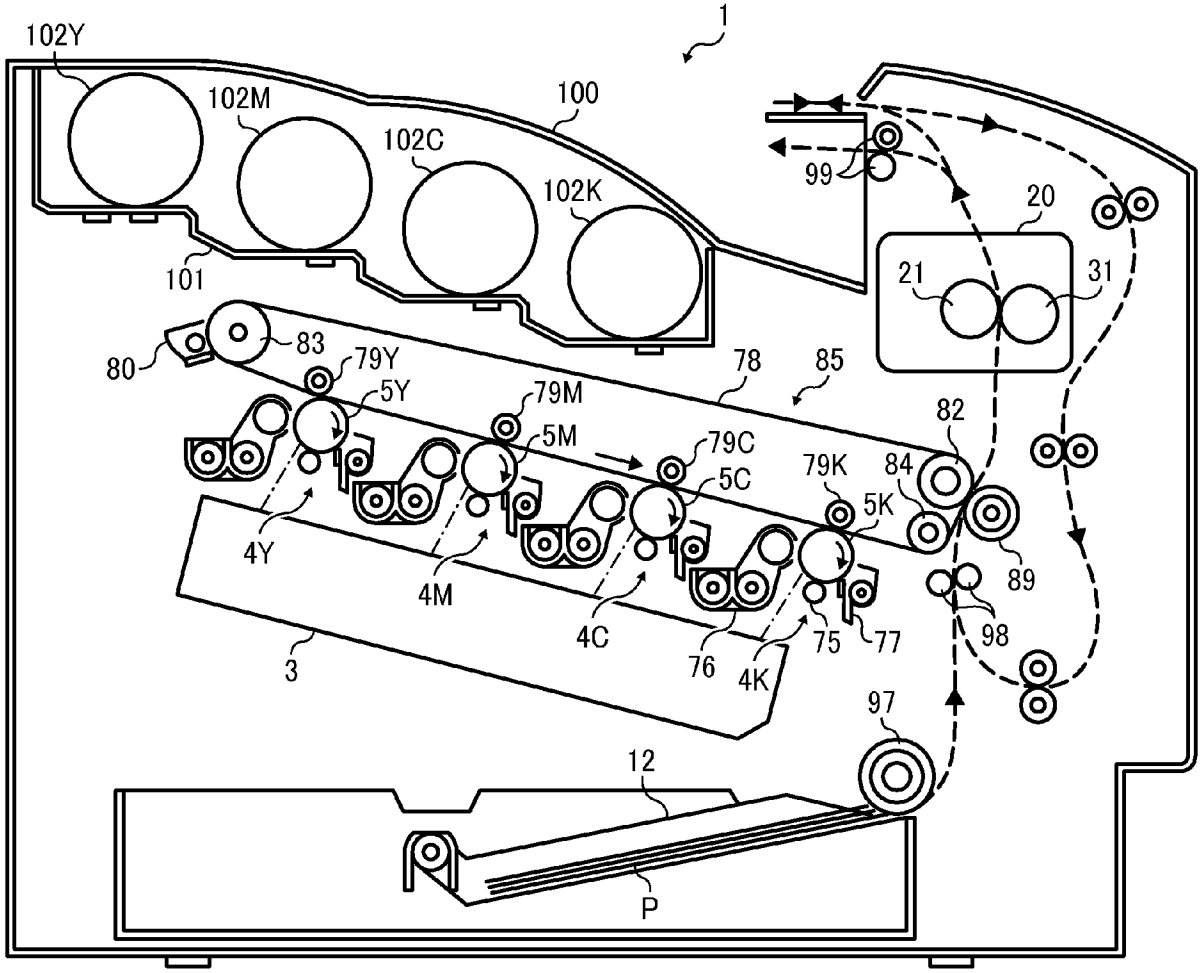
FIG. 1 is a schematic diagram of an embodiment of an image forming apparatus according to the present invention.

FIG. 1 is an image forming apparatus to which an embodiment according to the present invention can be applied. In FIG. 1, four toner bottles 102Y, 102M, 102C, and 102K corresponding to respective colors (yellow, magenta, cyan and black) are detachably provided in a bottle receiving unit 101 disposed at upper part of the main body of an image forming apparatus 1 that is a tandem color printer, respectively.

An intermediate transfer unit 85 having an intermediate transfer belt 78 is disposed beneath of the bottle receiving unit 101, and image forming units 4Y, 4M, 4C and 4K corresponding to the respective colors are provided in parallel to face the intermediate transfer belt 78. Photosensitive drums 5Y, 5M, 5C and 5K are provided in the imaging units 4, respectively. Around each photosensitive drum 5, a charging unit 75, a developing unit 76, a cleaning unit 77, and a neutralizing unit, not shown are provided. And an image forming process (involving a charging process, an exposing process, a developing process, a transfer process, and a cleaning process) is performed at each photosensitive drum 5 to form a color image of each color on a respective one of the photosensitive drums 5.

Each photosensitive drum 5 is driven to rotate clockwise in FIG. 1 by a drive motor, not shown, to charge the surface of each photosensitive drum 5 uniformly at the charging unit 75 (charging process). After that, when the surface of each photosensitive drum 5 reaches an irradiation position to be irradiated with the laser light emitted from the exposure unit 3, an electrostatic latent image corresponding to each color image is formed by an exposure scanning at this position (exposure process). When the surface of each photosensitive drum 5 reaches a position facing the developing unit 76, each electrostatic latent image is developed to form a toner image there (developing process). After that, when the surface of each photosensitive drum 5 reaches a position facing the intermediate transfer belt 78 and the respective primary bias rollers 79Y, 79M, 79C and 79K, the toner image on each photosensitive drum 5 is transferred onto the intermediate transfer belt 78 there (primary transfer process). At this time, a slight amount of untransferred toner remains on each photosensitive drum 5. Then, when the surface of each photosensitive drum 5 reaches a position facing the cleaning unit 77, the untransferred toner remaining on each photosensitive drum 5 is mechanically removed by a cleaning blade of the cleaning unit 77 there (cleaning process). Finally, when the surface of each photosensitive drum 5 reaches a position facing the neutralizing unit, not shown, the residual electrical potential on each photosensitive drum 5 is removed to complete a single image forming at each photosensitive drum 5. Further, the toner image formed on each photosensitive drum 5 through the developing process is transferred and superimposed on the intermediate transfer belt 78 so that a full color image is formed on the intermediate transfer belt 78.

The intermediate transfer unit 85 includes the intermediate transfer belt 78, respective primary transfer bias rollers 79, a secondary transfer backup roller 82, a cleaning backup roller 83, a tension roller 84, and an intermediate transfer cleaning unit 80. The intermediate transfer belt 78 is extended, wound around and supported by three rollers 82, 83 and 84, and is driven to travel by the drive rotation of the roller 82 in the direction shown by an arrow in FIG. 1. The respective primary transfer bias rollers 79 sandwich the intermediate transfer belt 78 with the respective photosensitive drums 5Y, 5M, 5C and 5K to form a primary transfer nip therebetween. To the respective primary transfer bias rollers 79Y, 79M, 79C and 79K, a transfer bias of a polarity opposite to the polarity of the toner is applied.

The intermediate transfer belt 78 travels in the direction shown by the arrow so that the intermediate transfer belt 78 passes through the primary transfer nip of the respective primary transfer bias rollers 79Y, 79M, 79C and 79K sequentially. Accordingly, the toner image of each color formed on the respective photosensitive drums 5Y, 5M, 5C and 5K is transferred and superimposed on the intermediate transfer belt 78. Then, the intermediate transfer belt 78, which has toner images of each color formed by being transferred and superimposed, rotates until it reaches a position facing the secondary transfer roller 89. At that position, the secondary transfer backup roller 82 sandwiches the intermediate transfer belt 78 with the secondary transfer roller 89 to form a secondary transfer nip therebetween. The four-color toner image formed on the intermediate transfer belt 78 is transferred onto the recording medium P conveyed to the secondary transfer nip. At that time, untransferred toner which has not been transferred to the recording medium P remains on the intermediate transfer belt 78. After that, when the intermediate transfer belt 78 reaches a position of the intermediate transfer cleaning unit 80, the untransferred toner on the intermediate transfer belt 78 is collected there to complete the transfer processes to be performed on the intermediate transfer belt 78.

In the meantime, the recording medium P is conveyed to the secondary transfer nip from a paper feed unit 12 disposed at a lower part of the main body of the apparatus through the paper feed roller 97 and a pair of registration rollers 98. Multiple recording media P such as a transfer sheet and the like are stacked and stored in the paper feed unit 12. When the paper feed roller 97 is driven to rotate counterclockwise in FIG. 1, a top sheet of the recording medium P is fed toward the pair of the registration rollers 98. The recording medium P conveyed to the pair of the registration rollers 98 is stopped at a nip of the pair of registration rollers 98, which stops rotating. Then, the pair of the registration rollers 98 is driven to rotate at a timing to transfer the color image on the intermediate transfer belt 78 onto the recording medium P, and the recording medium P is conveyed toward the secondary transfer nip. Accordingly, the desired color image is transferred onto the recording medium P. After that, the recording medium P on which the color image is transferred at the secondary transfer nip is conveyed to the fixing device 20, and the color image transferred to the surface thereof is fixed onto the recording medium P by heat from the fixing belt 21 and pressure from the pressure roller 31. Then, the recording media P are output to the outside of the apparatus by a paper output roller pair 99, and stacked in a stacking unit 100 sequentially as output image products. Thus, a series of image forming processes in the image forming apparatus 1 is completed.

Figure 2:
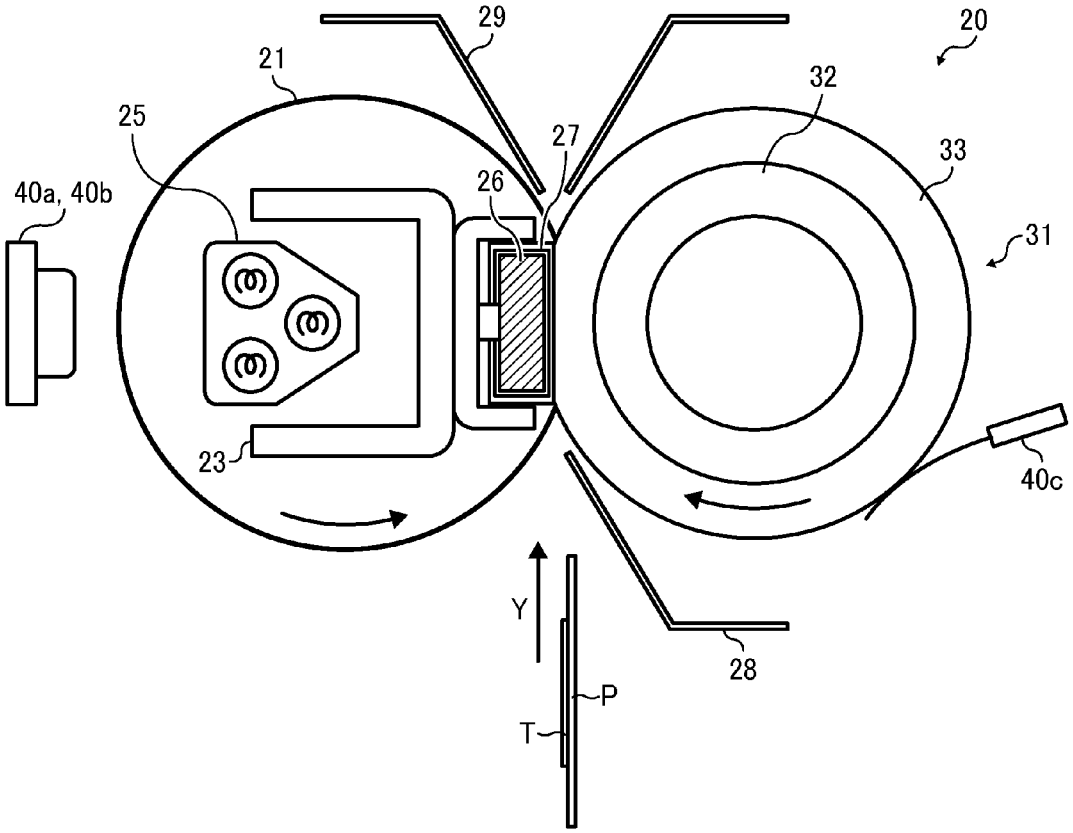
FIG. 2 is a schematic diagram of the fixing device according to the present invention.
Figure 3:
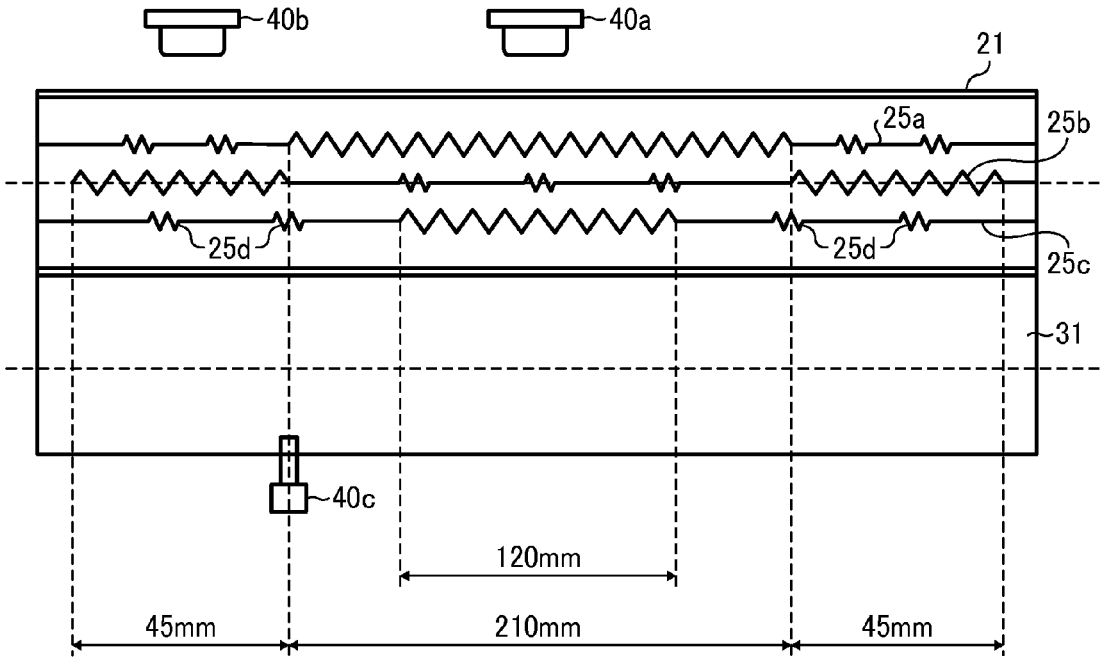
FIG. 3 is a schematic diagram illustrating a heater and a temperature sensor of the fixing device employed in the embodiment according to the present invention.
Figure 4:
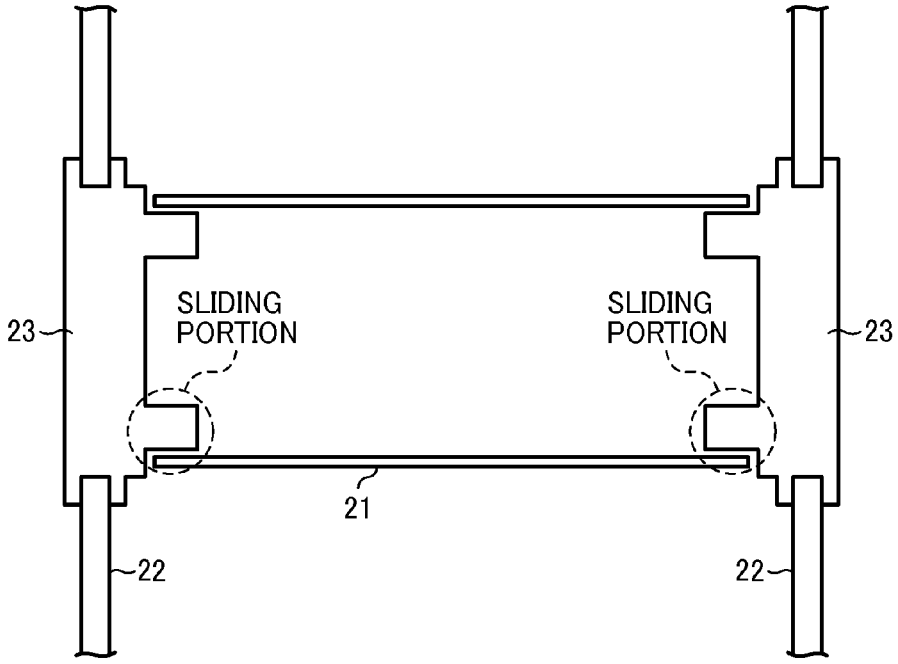
FIG. 4 is a schematic diagram of a fixing member used in the embodiment of the image forming apparatus.

Next, the configuration and the operation of the fixing device 20 are described referring to FIGS. 2, 3, and 4. As shown in FIG. 2, the fixing device 20 includes a fixing belt 21 that is a fixing member, a reinforcing member 23, a heater 25 which forms a heating unit, a pressure roller 31 that is a pressure member, and a temperature sensor 40.

The fixing belt 21 is a thin and flexible endless belt, and travels in a counterclockwise direction in FIG. 2. The fixing belt 21 includes elastic layers and release layers being stacked sequentially on the substrate to have a total thickness of less than 1 mm. The substrate of the fixing belt 21 is formed of a metallic material such as nickel or stainless steel, or a resin material such as polyimide or the like, which have a thickness in a range between 30 μm and 50 μm. The elastic layer of the fixing belt 21 is formed of a rubber material such as silicone rubber, foaming silicone rubber, fluoro rubber, etc. having a thickness in a range between 100 μm and 300 μm. Since the elastic layer is provided, tiny irregularities will not be formed on the surface of the fixing belt 21 at the nip. Accordingly, heat can be transmitted uniformly to the toner image T on the recording medium P so as to prevent orange peel surface image from occurring. The release layer of the fixing belt 21 is formed of material such as PFA (4 ethylene bar fluoroalkyl vinyl ether copolymer resin fluoride), PTFE (polytetrafluoroethylene), polyimide, polyetherimide, PES (Polyether sulfide), etc. of a thickness in a range between 10 μm and 50 μm. Thus, by providing the release layer, it is possible to secure fine mold release property for the toner T (peeling capability). The diameter of the fixing belt 21 is set in a range between 15 mm and 120 mm, and in this embodiment, the diameter of the fixing belt 21 is set to 30 mm.

The heaters 25, a reinforcing member 23, etc. are fixed to the inside of the fixing belt 21 (the inner peripheral surface side). The fixing belt 21 is pressed by the abutting member 26 reinforced by the reinforcing member 23 and the sliding member 27 to form a nip between the pressure roller 31 and the fixing belt 21. In this embodiment, the reinforcing member 23 to reinforce the strength of the sliding member 27 and the abutting member 26 in the nip is fixed to the inner peripheral surface side of the fixing belt 21. The reinforcing member 23 is formed so that a length of the reinforcing member 23 in the width direction is substantially equal to the length of the abutting member 26 and the sliding member 27, both ends of the reinforcing member 23 in the width direction are fixed to and supported by side plates 22 of the fixing device 20 as shown in FIG. 4. The reinforcing member 23 is brought into contact with the pressure roller 31 through the abutting member 26, the sliding member 27, and the fixing belt 21 to prevent the contact member 26 and the sliding member 27 from greatly deforming under pressure of the pressure roller 31 at the nip. More specifically, when the reinforcing member 23 is not provided, the abutting member 26 and the sliding member 27 may be bent by the pressure roller 31.

However, in this embodiment, since the reinforcing member 23 is disposed at a position to minimize the deformation of the abutting member 26 and the sliding member 27, it is possible to reduce the deflection of the abutting member 26 and the sliding member 27. It is preferable to form the reinforcing member 23 using a metal material having high mechanical strength, such as stainless steel or iron, to achieve the function described above. Further, the reinforcing member 23 is formed to have a horizontally long cross-section along the pressure direction of the pressure roller 31 so that section modulus is increased. As a result, it is possible to increase the mechanical strength of the reinforcing member 23. Further, part or all of the counter surfaces of the reinforcing member 23 that face the heater 25 may include an insulating member, or may be given a mirror finish. With this configuration, since heat directed toward the reinforcement member 23 from the heater 25 (heat to heat the reinforcement member 23) can be used to heat the fixing belt 21, the heating efficiency for the fixing belt 21 is improved further.

Both ends of the heater 25, which may be a halogen heater or a carbon heater, are fixed to the side plate 22. The fixing belt 21 is heated by radiation heat of the heater 25 whose output is controlled by the power supply unit provided in the main body of the apparatus. Further, heat is applied to the toner image T on the recording medium P from the surface of the fixing belt 21 that is heated. The output control of the heater 25 is based on the detection result of the belt surface temperature detected by a temperature sensor 40 such as a thermopile, etc. that faces the surface of the fixing belt 21. Accordingly, it is possible to set the temperature of the fixing belt 21 to a desired temperature (fixing temperature) by this output control.

Thus, in the fixing device 20 according to the present embodiment, the fixing belt 21 is heated substantially entirely in the circumferential direction, not only a part of the fixing belt 21 locally. Accordingly, even when the device performance is improved and the device performs a high-speed operation, the fixing belt 21 can be heated sufficiently so that it is possible to prevent poor fixing operation from occurring. More specifically, it is possible to heat the fixing belt 21 efficiently with a relatively uncomplicated device configuration. Accordingly, it is possible to reduce the size of the device in addition to achieving short warm-up time and short time to first print.

As shown in FIG. 2, the diameter of the pressure roller 31 in the present embodiment is 30 mm, and the pressure roller 31 is formed by forming the elastic layer 33 on the hollow core metal 32. The elastic layer 33 is formed of a material such as foaming silicone rubber, silicone rubber, fluorine rubber or the like. Optionally, a thin release layer consisting of PFA, PTFE or the like may be formed on the surface of the elastic layer 33. The pressure roller 31 presses the fixing belt 21 to form a desired nip between the members.

Further, a gear, not shown, engaged with the driving gear of a drive mechanism, not shown, is provided on the pressure roller 31. The pressure roller 31 is driven to rotate clockwise in FIG. 2. Both ends of the pressure roller 31 in the width direction are rotatably supported by the side plate 22 via bearings, not shown. Optionally, a heat source such as a halogen heater may be provided inside the pressure roller 31.

When the elastic layer 33 of the pressure roller 31 is formed of a sponge material such as foaming silicone rubber and the like, it is possible to reduce pressure applied to the nip. Accordingly, it is possible to reduce the deflection of the abutting member 26 and the sliding member 27 more efficiently. Furthermore, since the heat insulation of the pressure roller 31 is increased, heat of the fixing belt 21 is less likely to be transmitted to the pressure roller 31, therefore, the heating efficiency of the fixing belt 21 is improved.

Further, in this embodiment, the device is configured so that the diameter of the fixing belt 21 is equal to the diameter of the pressure roller 31. However, the device may be formed so that the diameter of the fixing belt 21 is smaller than the diameter of the pressure roller 31. In such a case, since the curvature of the fixing belt 21 at the nip is smaller than that of the pressure roller 31, the recording medium P fed from the nip can be separated from the fixing belt 21 more easily.

A description is now given of the operation of the fixing device 20 described above.

When a power switch provided in the main body of the apparatus is turned on, power is supplied to the heater 25, and the pressure roller 31 starts to be rotated. Therefore, the fixing belt 21 is also driven to travel by a frictional force between the pressure roller 31 and the fixing belt 21. After that, the recording medium P is fed from the paper feed unit 12, and unfixed color image is transferred onto the recording medium P at a position of the secondary transfer roller 89. The recording medium P carrying the unfixed image T (toner image) is guided by a guide plate 28, is conveyed in the direction shown by arrow Y in FIG. 2, is fed to the nip between the fixing belt 21 and the pressure roller 31 which are in a state of close contact. A toner image T on the surface of the recording medium P is fixed by heat of the fixing belt 21 heated by the heater 25 and pressing force of the abutting member 26 reinforced by the reinforcement member 23 and the sliding member 27 and the pressure roller 31. Then, the recording medium P fed from the nip is conveyed in the direction shown by arrow Y.

In the fixing device which is configured to have a low thermal capacity to reduce the warm-up time as described above, it is possible to maintain an appropriate temperature without lowering productivity even when papers of small size such as postcards or envelopes have been processed continuously, and even when the paper size is changed from large to small. How this control is accomplished is described below.

As shown in FIG. 3, the heater 25 includes a first heater 25*a* having a heat generating portion in a region smaller than the maximum paper width, a second heater 25*b* having a heat generating portion outboard of the first heater 25*a*, and a third heater 25*c* having a heat generating portion inboard of the first heater 25*a*. In this embodiment, the length of the heat generating portion of the first heater 25*a* is 210 mm (corresponding to the vertical paper width of A4 size), the heat generating portion of the second heater 25*b* is 45 mm, and the length of the heat generating portion of the third heater 25*c* is 120 mm. The length of the heat generating portion of the third heater 25*c* is 120 mm to accommodate envelopes or postcards.

The temperature sensor 40 includes a first sensor 40*a* formed of a thermopile which detects the temperature of the fixing belt 21 at a region of the heat generating portion of the first heater 25*a* and a second sensor 40*b* formed of thermopile which detects the temperature of the fixing belt 21 at a region of the heat generating portion of the second heater 25*b*. Further, the third sensor 40*c* formed of a thermistor which detects the temperature of the pressure roller 31 is disposed at a position axially outside of the heat generating portion of the third heater 25*c*, which is approximately equal to a position of a weak heat generating portion 25*d* of the third heater 25*c* in the axial direction. In the configuration described above, a main heater is formed of the first heater 25*a* and the second heater 25*b*, and a sub-heater is formed of the third heater 25*c*. The main heater and sub-heater can be switched on and off selectively.

Figure 5:
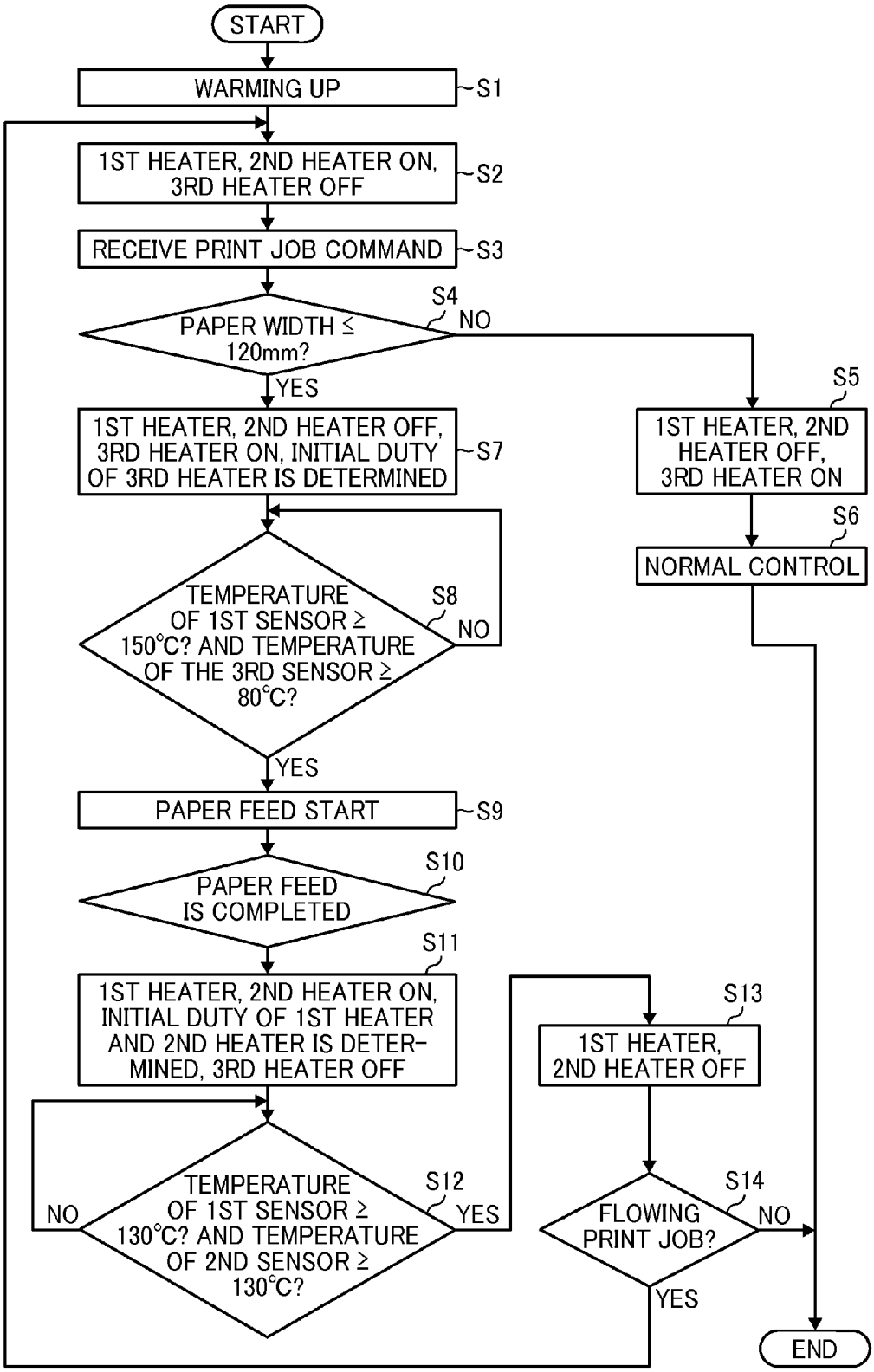
FIG. 5 is a flow chart illustrating an operation in the embodiment according to the present invention.
Figure 6:
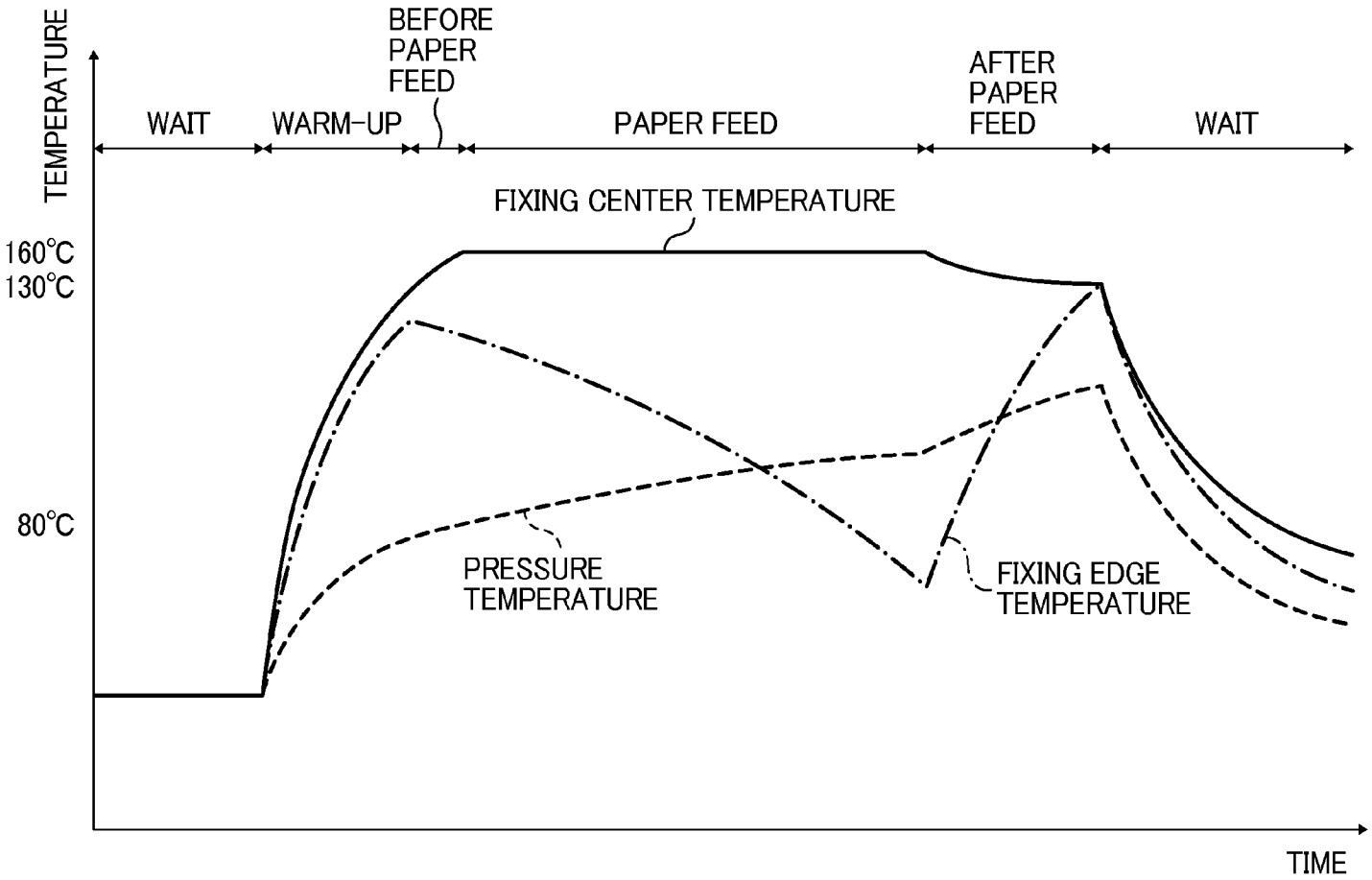
FIG. 6 is a graph showing a relation between temperature and states of the fixing device in the embodiment according to the present invention.

Referring to FIGS. 5 and 6, a switching procedure to switch between a control by the first heater 25*a* and the second heater 25*b*, that is a control by the main heater, and a control by the third heater 25*c*, that is a control by the sub-heater, is described.

At the start of the warm-up (step ST1), the first heater 25*a* and the second heater 25*b* are turned on, and the third heater 25*c* is turned off (ST2), when a print job command is received (ST3), it is determined whether or not the print job received is for paper having a width of less than 120 mm (ST4). When the paper width is not less than 120 mm, the first heater 25*a* and the second heater 25*b* are turned on, and the third heater 25*c* is turned off (ST5) to perform a normal control (ST6).

In ST4, when the paper width is less than 120 mm, PID temperature control (controlling operating amount of the heater per unit time in accordance with a difference between an actual temperature and a target temperature) by the first heater 25*a* and the second heater 25*b* is turned off and PID temperature control by the third heater 25*c* is begun. In this case, between the first heater 25*a* and the second heater 25*b* and the third heater 25*c*, the output power per unit distance and the output power per unit length are different, whether or not an obstacle is present, the efficiency, and so on, are different. Accordingly, if the same output duty is transferred, the temperature may drop or there may be a temperature overshoot.

Figure 7:
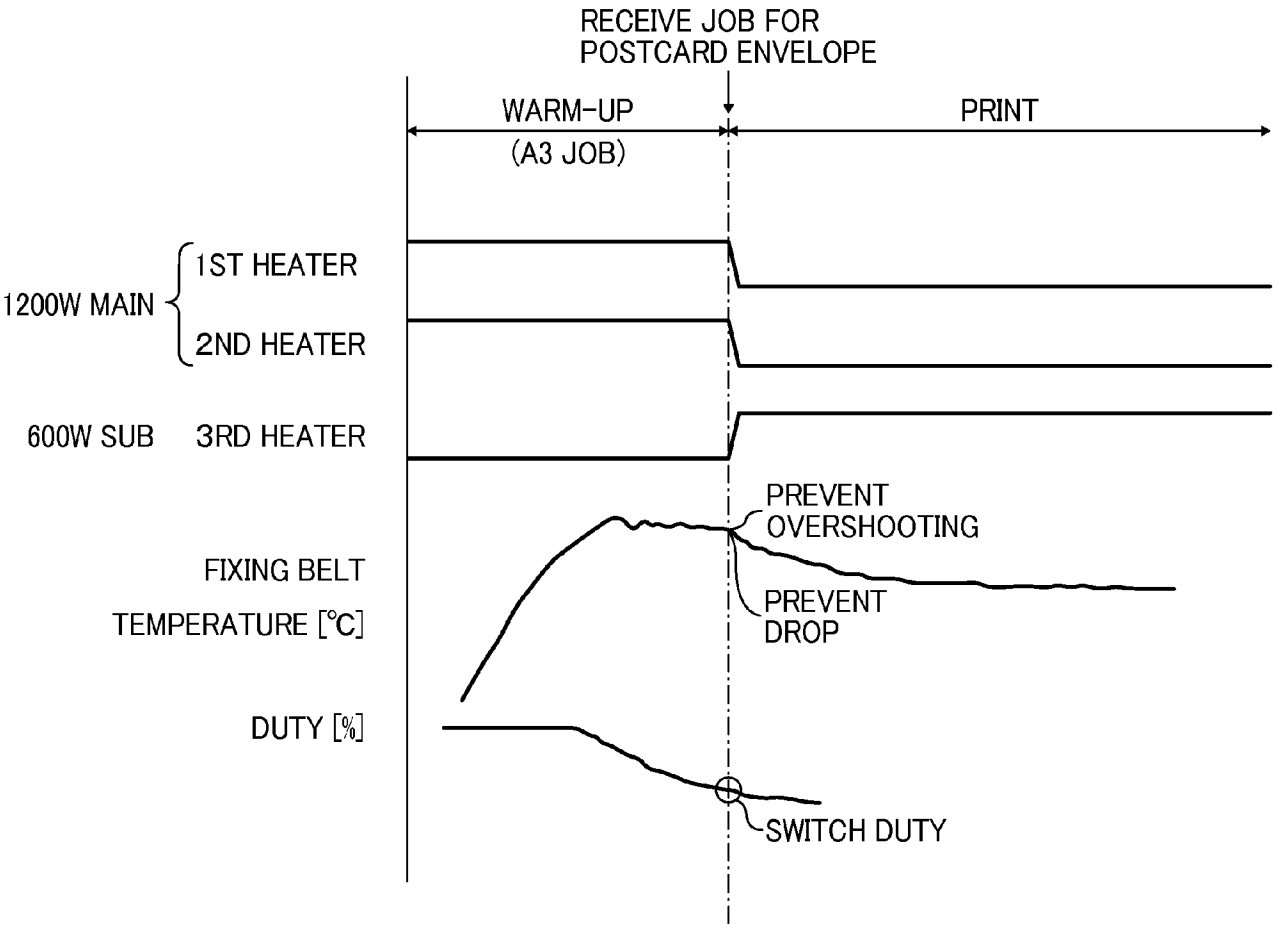
FIG. 7 is a schematic diagram illustrating each state of the heater and a lighting rate of the fixing belt in the embodiment according to the present invention.

Therefore, at the start of PID temperature control by the third heater 25*c*, the initial duty ratio (initial duty) at the start of PID temperature control by the third heater 25*c* is determined in accordance with a difference between the temperature detected by the first sensor 40*a* and the target temperature for the paper feed of the print job (150° C. in this embodiment) (ST7). More specifically, the initial duty ratio is set at 100% when the temperature difference is equal to or greater than 20° C., the initial duty ratio is set at 60% when the temperature difference is equal to or less than 20° C., and the initial duty ratio is set at 20% when the temperature difference is equal to or higher than the target temperature for the paper feed, that is 150° C. Accordingly, as shown in FIG. 7, when control by the first heater 25*a* and the second heater 25*b* is switched to control by the third heater 25*c*, it is possible to reduce the occurrence of temperature overshooting and temperature drop so that an excellent fixing capability can be ensured without lowering productivity.

Next, the starting conditions of a print job are described when the paper width of the received print job is equal to or less than 120 mm. The starting conditions of the print job are that the temperature of the fixing belt 21 is equal to or higher than 150° C. and the temperature of the pressure roller 31 is equal to or higher than 80° C. (ST8). The third sensor 40*c*, which detects the temperature of the pressure roller 31, is disposed at a position outside of the heat generating portion of the third heater 25*c* in the axial direction as shown in FIG. 3, and the temperature is not increased in the region other than the region within 120 mm over which the paper passes. Therefore, it is not possible to detect the temperature of the third heater 25*c*. However, in this embodiment, the weak heat generating portion 25*d* is provided in the third heater 25*c*, and the third sensor 40*c* is disposed at proximate to the weak heat generating portion 25*d* in the axial direction. By detecting the temperature of this weak heat generating portion 25*d* by the third sensor 40*c*, it is possible to detect the temperature increase in the region within 120 mm which is the region of the pressure roller 31 over which the paper passes. Based on this detection result, the paper feed starts when it is confirmed that the temperature of the fixing belt 21 is equal to or higher than 150° C. and the temperature of the pressure roller 31 is equal to or higher than 80° C. (ST9).

Figure 8:
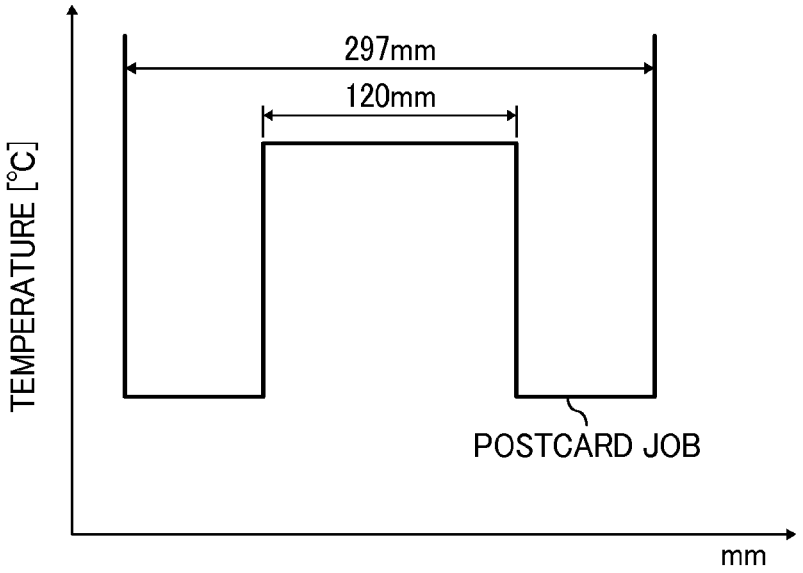
FIG. 8 is a schematic diagram illustrating a relation between position of the fixing device in the width direction and temperature in the embodiment according to the present invention.

The control procedure after completion of the print job is described. After completion of the paper feed (ST10), immediately after the paper is fed while being heated only by the third heater 25*c*, as shown in FIG. 8, the temperatures of the region other than the region within 120 mm around the center portion that is the heat generating portion of the third heater 25*c* are low. Accordingly, it is necessary to make the temperature distribution uniform in the axial direction to ensure good fixing performance for edge portions of the paper even if the paper width of the next print job is wider than 120 mm. Immediately after the paper feed, by heating such that the temperature detected by the second sensor 40*b* disposed at the end portion of the fixing belt 21 becomes the same as the temperature detected by the first sensor 40*a* disposed at the center portion of the fixing belt 21, it is possible to obtain a uniform temperature distribution in the axial direction.

In this embodiment, immediately after the print job is completed, PID temperature control by the third heater 25*c* is turned off, and PID temperature control by the first heater 25*a* and the second heater 25*b* is started (ST11). When both temperatures detected by first sensor 40*a* and the second sensor 40*b* become equal to or greater than a predetermined temperature (130° C. in this embodiment) (ST12), PID temperature control by the first heater 25*a* and the second heater 25*b* is turned off (ST13). It is determined whether or not there is a next print job (ST14). Then, the process returns to ST2 if there is a next print job and the process ends if there is no next print job.

Further, when a print job for the paper having a width of wider than 120 mm is received while performing a printing operation for the paper having a width of less than 120 mm, the next print job is started after the above operation has been completed. With the procedure described above, it is possible to obtain a uniform temperature distribution in the axial direction (paper width direction) of the fixing device 20 so that it is possible to carry out a good fixing operation continuously regardless of the size of the paper, thereby obtaining good print products continuously.

In the configuration described above, when the print jobs are performed continuously for the paper having a width equal to or less than 120 mm which is the heat generating portion of the third heater 25*c*, the fixing device 20 is operated without performing the actual print operation for a predetermined time while all the heaters 25*a*, 25*b* and 25*c* are turned off, then, the fixing device 20 is operated until the temperature becomes a predetermined value while the first heater 25*a* and the second heater 25*b* are on. After that, the first heater 25*a* and the second heater 25*b* are turned off and the third heater 25*c* is turned on. With this procedure, it is possible to obtain an excellent fixing for the first paper after performing several print jobs continuously. At this moment, when the print job for the paper width wider than 120 mm is received, the next print job is started after performing the operation shown in FIG. 5. Consequently, it is possible to obtain the same effect as in the embodiment described above.

Figure 9:
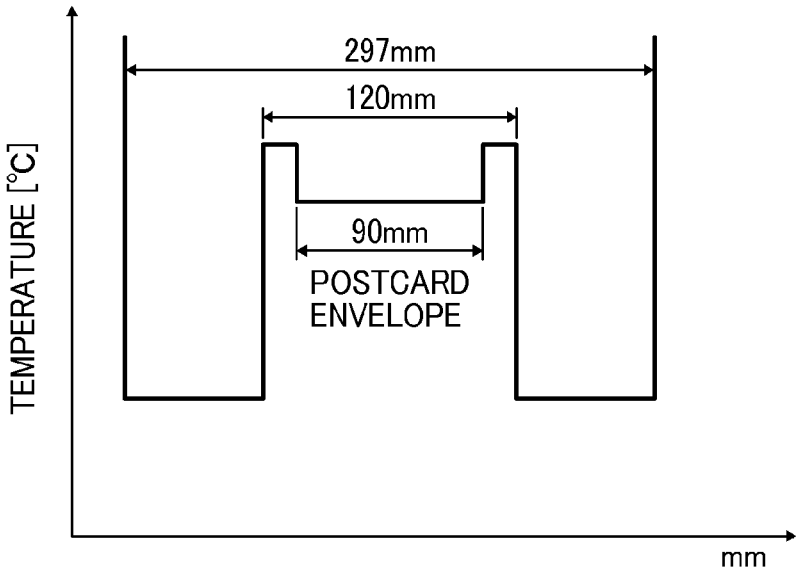
FIG. 9 is a schematic diagram illustrating a relation between position of the fixing device in the width direction and temperature in the embodiment according to the present invention.

In the configuration described above, when the print jobs are performed continuously for paper having a width less than 110 mm which is smaller than the heat generating portion of the third heater 25*c*, and when the number of printed sheets being processed exceeds 30, the temperatures at both ends of the heat generating portion of the third heater 25*c* become high compared to the center region where the papers are passing as shown in FIG. 9. Accordingly, there is a problem that a fixing failure may occur when the paper having a width of wider than 120 mm is processed later. This is because, in this embodiment, it is not possible to detect the temperature increase at the region where the papers are not passing when the papers are fed while the paper are heated only by the third heater 25*c*. Accordingly, if the number of the papers to be processed is larger than 30, the printing speed may be slowed down. In the embodiment according to the present invention, since PID temperature control is performed, the lighting duty ratio is lowered when the printing speed is slowed down. As a result, excessive temperature increase is prevented, therefore, it is possible to obtain excellent printed images.

Further, after the print job is performed while the printing speed is slowed down, it is desirable that all the heaters 25*a*, 25*b*, and 25*c* are turned off after the print job is completed, and the fixing device 20 is operated without performing actual operation for a predetermined time corresponding to the number of papers which have been processed continuously. By this procedure, the temperature values at both ends of the heat generating portion in FIG. 9 are reduced so that it is possible to obtain a uniform temperature distribution in the axial direction of the fixing device 20, and carry out a good fixing operation continuously regardless of the size of the paper, thereby obtaining good printed images continuously.

In this embodiment, a configuration using a halogen heater as the heat source is described as an example. However, the disclosure of the present invention is not limited thereto, and thus, the fixing device may include, for example, a ceramic heater in the nip and may include a planar heater which is flexible and is fixed to an inner surface of the heating member.

What is claimed is:

1. A fixing device comprising:

a fixing member configured to heat a recording medium and including a heating unit to heat regions corresponding to different paper sizes along an axial direction of the fixing member; and a pressure member configured to contact the fixing member firmly, the heating unit including:

a sub-heater having a heat generating portion in a region smaller than a minimum paper width, the sub-heater being closest to the pressure member;

a main heater having a heat generating portion at least at a region outside of the sub-heater;

a first temperature detector to detect a temperature of the fixing member at the heat generating portion of the main heater; and a second temperature detector to detect a temperature of the fixing member at the heat generating portion of the sub-heater, wherein the heating unit can be selectively switched between the main heater and the sub-heater.

2. The fixing device according to claim 1, wherein an initial duty ratio at the start of PID temperature control by the sub-heater is determined based on a difference between a temperature of the fixing member at the start of PID temperature control by the sub-heater and a target temperature.

3. The fixing device according to claim 2, wherein the initial duty ratio at the start of PID temperature control by the sub-heater is determined with a multi-stage.

4. The fixing device according to claim 1, wherein the main heater is turned off when the temperatures detected by the first and second temperature detectors exceed set values after the sub-heater is turned off and PID temperature control by the main heater is started.

5. The fixing device according to claim 4, wherein after the fixing device is activated without performing actual operation for a set time while the main heater and the sub-heater are turned off, the fixing device is operated until the temperature is increased to a set temperature while the main heater is turned on, after which the main heater is turned off and the sub-heater is turned on.

6. The fixing device according to claim 4, wherein after the sub-heater is turned off and PID temperature control by the main heater is started, when the temperatures detected by the respective temperature detectors exceed set values, the main heater is turned off, and a next print job is started.

7. The fixing device according to claim 1, wherein a printing speed of a print job is slowed down when the number of pages printed exceeds a set value.

8. The fixing device according to claim 7, wherein after the print job, the fixing device is activated without performing actual operation while the main heater and sub-heater are turned off for a set time corresponding to the number of the pages continuously printed.

9. The fixing device according to claim 1, further comprising a surface temperature detector configured to detect a surface temperature of the pressure roller and provided at a position corresponding to the heat generating portion of each heater.

10. An image forming apparatus comprising the fixing device of claim 1.

11. The fixing device according to claim 1, wherein the main heater is formed of a first heater and a second heater, and the sub-heater is formed of a third heater.

12. The fixing device according to claim 11, wherein the first heater has a heat generating portion in a region smaller than the maximum paper width, the second heater having a heat generating portion outboard of the first heater, and the third heater having a heat generating portion inboard of the first heater.

13. The fixing device according to claim 11, wherein the second heater is disposed between the first and third heaters in an axial direction.

14. The fixing device according to claim 1, further comprising a third temperature detector to detect a temperature of the pressure member.

15. The fixing device according to claim 14, wherein the third temperature detector is disposed at a position axially outside of a heat generating portion of a third heater.

16. The fixing device according to claim 1, further comprising a reinforcing member, an abutting member, and a sliding member disposed inside of the fixing member.

17. The fixing device according to claim 16, wherein the fixing member is pressed by the abutting member reinforced by the reinforcing member and the sliding member to form a nip between the pressure member and the fixing member.

18. The fixing device according to claim 17, wherein a length of the reinforcing member in a width direction is substantially equal to a length of the abutting member and the sliding member.

19. The fixing device according to claim 16, wherein both ends of the reinforcing member in the width direction are fixed to and supported by side plates of the fixing member.

20. The fixing device according to claim 16, wherein the reinforcing member is brought into contact with the pressure member through the abutting member, the sliding member, and the fixing member to prevent the contact member and the sliding member from deforming under pressure of the pressure member at the nip.

* * * * *